US007481528B2

(12) United States Patent
Fan et al.

(10) Patent No.: US 7,481,528 B2
(45) Date of Patent: Jan. 27, 2009

(54) DIGITAL PRINTING TOY

(75) Inventors: Nong-Qiang Fan, Issaquah, WA (US); Jie Xiao, Issaquah, WA (US)

(73) Assignee: RD & IP, L.L.C.

( * ) Notice: Subject to any disclaimer, the term of this patent is extended or adjusted under 35 U.S.C. 154(b) by 526 days.

(21) Appl. No.: 11/163,098

(22) Filed: Oct. 5, 2005

(65) Prior Publication Data

US 2007/0008353 A1 Jan. 11, 2007

Related U.S. Application Data

(63) Continuation-in-part of application No. 10/428,177, filed on May 2, 2003, now Pat. No. 6,991,332.

(51) Int. Cl.
*B41J 3/36* (2006.01)

(52) U.S. Cl. ..... 347/109; 347/108

(58) Field of Classification Search ..... 347/101, 347/107, 108, 109
See application file for complete search history.

(56) References Cited

U.S. PATENT DOCUMENTS 5,163,846 A * 11/1992 Lee ..... 434/408
5,988,900 A * 11/1999 Bobry ..... 347/109
2002/0018108 A1 * 2/2002 Day et al. ..... 347/108

* cited by examiner

*Primary Examiner*—Manish S Shah

(57) ABSTRACT

A digital toy kit includes a picture book and a digital printing toy. At least one of the pages on the picture book includes one or more pictures and words. The digital printing toy includes a frame member that has a cavity, an ink jet printing head that has one or more nozzles, a memory storing a plurality of objects, a display area, a selection button operative to select an object, and a printing control circuit. The ink jet printing head can be activated to move inside the cavity of the frame member when it is pressed against a chosen page on the picture book. The printing control circuit controls the nozzles on ink jet printing head to project an ink pattern on the chosen page on the picture book when the ink jet printing head moves inside the cavity of the frame member.

43 Claims, 17 Drawing Sheets

DIGITAL PRINTING TOY

This application is a Continuation-In-Part application of U.S. application Ser. No. 10/428,177, filed May 2, 2003, which are hereby incorporated herein by reference.

BACKGROUND

The present invention relates generally to digital printing toys.

FIG. 1 shows a conventional hand stamp 10 that can be used to imprint a word "PAID" on a supporting surface 50. Conventional hand stamp 10 includes a frame member 14 and an operating member 12. Operating member 12 is operatively associated with frame member 14. A stamp plate 16 is attached to the end of frame member 14. A mirror image of the word "PAID" is inscribed on stamp plate 16.

When several words or images are to be imprinted, conventional stamp 10 is not very convenient. For example, if one needs to imprint two words "PAID" and "VOID", one may have to use two stamps: one stamp for imprinting word "PAID" and one stamp for imprinting word "VOID". Alternatively, one may use one stamp and attach on the stamp a stamp plate that is selected from two stamp plates: one stamp plate for imprinting word "PAID" and one stamp plate for imprinting word "VOID".

A digital hand stamp that can imprint multiple images clearly has advantages over the conventional hand stamp 10.

SUMMARY

In one aspect, instant application is directed to a method for teaching a child to learn the name of an object using a digital printing toy. The digital printing toy has a memory and a display area. The method includes storing multiple objects in the memory. The method includes selecting an object from the multiple objects. The method includes displaying a name of the selected object on the display area. The method includes holding the digital printing toy against a supporting surface. The method includes activating an ink jet printing head to slide inside a cavity on a frame member of the digital printing toy. The method includes controlling nozzles on the ink jet printing head to project an ink pattern on the supporting surface when the ink jet printing head slides inside the cavity of the frame member. Here, the ink pattern on the supporting surface represents an image of the selected object.

Implementations of the method for teaching a child to learn the name of an object may include one or more of the following features. The method can include storing in the memory at least a name and at least an image for at least one of the multiple objects. The method can include activating an ink jet printing head to slide inside a cavity on a frame member of the digital hand stamp while keeping a substantially constant distance between the inkjet printing head and the supporting surface. The method can include pressing an activation button to activate the ink jet printing head to slide inside the cavity of the frame member when the digital printing toy is pressed against the supporting surface. The method can include pressing the digital printing toy against the supporting surface to activate the ink jet printing head to slide inside the cavity of the frame member automatically. The method can include moving the frame member relative to a operating member by a distance larger than a threshold to activate the ink jet printing head to slide inside the cavity of the frame member automatically. The method can include moving a leg relative to the frame member by a distance larger than a threshold to activate the ink jet printing head to slide inside the cavity of the frame member automatically. The method can include lifting the digital printing toy when an indicator on the digital printing toy indicates that that the ink jet printing head finishes printing the ink pattern on the supporting surface. The method can include pronouncing the name of the selected object with a speaker on the digital printing toy.

In another aspect, instant application is directed to a method for teaching a child to learn the name of an object using a digital printing toy. The digital printing toy has a memory and a display area. The method includes storing multiple objects in the memory. The method includes selecting an object from the multiple objects. The method includes displaying an image of the selected object on the display area. The method includes holding the digital printing toy against a supporting surface. The method includes activating an ink jet printing head to slide inside a cavity on a frame member of the digital printing toy. The method includes controlling nozzles on the inkjet printing head to project an ink pattern on the supporting surface when the ink jet printing head slides inside the cavity of the frame member. Here, the ink pattern on the supporting surface represents a name of the selected object.

Implementations of the method for teaching a child to learn the name of an object may include one or more of the following features. The method can include storing in the memory at least a name and at least an image for at least one of the multiple objects. The method can include activating an ink jet printing head to slide inside a cavity on a frame member of the digital hand stamp while keeping a substantially constant distance between the inkjet printing head and the supporting surface. The method can include pressing an activation button to activate the ink jet printing head to slide inside the cavity of the frame member when the digital printing toy is pressed against the supporting surface. The method can include pressing the digital printing toy against the supporting surface to activate the ink jet printing head to slide inside the cavity of the frame member automatically. The method can include moving the frame member relative to a operating member by a distance larger than a threshold to activate the ink jet printing head to slide inside the cavity of the frame member automatically. The method can include moving a leg relative to the frame member by a distance larger than a threshold to activate the ink jet printing head to slide inside the cavity of the frame member automatically. The method can include lifting the digital printing toy when an indicator on the digital printing toy indicates that that the ink jet printing head finishes printing the ink pattern on the supporting surface. The method can include pronouncing the name of the selected object with a speaker on the digital printing toy.

In another aspect, instant application is directed to a digital printing toy operable to print an image of an object on a supporting surface. The digital printing toy includes a frame member having a cavity, an ink jet printing head having one or more nozzles, a memory, a selection button, a display area, and a printing control circuit. The ink jet printing head is operable to be activated to slide inside the cavity of the frame member when the digital printing toy is pressed against the supporting surface. The memory is operable to store multiple objects. The selection button is operable to select an object from the multiple objects. The display area is operable to display a name of a selected object. The printing control circuit controls the nozzles on ink jet printing head to project an ink pattern on the supporting surface when the ink jet printing head slides inside the cavity of the frame member. Here, the ink pattern on the supporting surface represents an image of the selected object.

Implementations of the digital printing toy may include one or more of the following features. In the digital printing toy, the memory has at least a name and at least an image stored therein for at least one of the multiple objects. The digital printing toy can include a sliding guide inside the cavity, and the ink jet printing head is operable to be activated to slide along the sliding guide. The digital printing toy can include an activation button operable to be pressed to activate the ink jet printing head to slide inside the cavity of the frame member when the digital printing toy is pressed against the supporting surface. In the digital printing toy, the ink jet printing head is operable to be activated automatically to slide inside the cavity of the frame member when the digital printing toy is pressed against the supporting surface. The digital printing toy can include an operating member. In the digital printing toy, the frame member is movable relative to the operating member, and the ink jet printing head is operable to be activated automatically to slide inside the cavity of the frame member when the frame member moves relative to the operating member by a distance larger than a threshold. The digital printing toy can include a leg movable relative to the frame member. In the digital printing toy, the ink jet printing head is operable to be activated automatically to slide inside the cavity of the frame member when the leg moves relative to the frame member by a distance larger than a threshold. The digital printing toy can include an indicator operable to indicate that the ink jet printing head finishes printing the ink pattern on the supporting surface. In the digital printing toy, the ink jet printing head can be a color ink jet printing head. The digital printing toy can include a speaker.

In another aspect, instant application is directed to a digital printing toy operable to print a name of an object on a supporting surface. The digital printing toy includes a frame member having a cavity, an ink jet printing head having one or more nozzles, a memory, a selection button, a display area, and a printing control circuit. The ink jet printing head is operable to be activated to slide inside the cavity of the frame member when the digital printing toy is pressed against the supporting surface. The memory is operable to store multiple objects. The selection button is operable to select an object from the multiple objects. The display area is operable to display an image of a selected object. The printing control circuit controls the nozzles on ink jet printing head to project an ink pattern on the supporting surface when the ink jet printing head slides inside the cavity of the frame member. Here, the ink pattern on the supporting surface represents a name of the selected object.

Implementations of the digital printing toy may include one or more of the following features. In the digital printing toy, the memory has at least a name and at least an image stored therein for at least one of the multiple objects. The digital printing toy can include a sliding guide inside the cavity, and the ink jet printing head is operable to be activated to slide along the sliding guide. The digital printing toy can include an activation button operable to be pressed to activate the ink jet printing head to slide inside the cavity of the frame member when the digital printing toy is pressed against the supporting surface. In the digital printing toy, the ink jet printing head is operable to be activated automatically to slide inside the cavity of the frame member when the digital printing toy is pressed against the supporting surface. The digital printing toy can include an operating member. In the digital printing toy, the frame member is movable relative to the operating member, and the ink jet printing head is operable to be activated automatically to slide inside the cavity of the frame member when the frame member moves relative to the operating member by a distance larger than a threshold. The digital printing toy can include a leg movable relative to the frame member. In the digital printing toy, the ink jet printing head is operable to be activated automatically to slide inside the cavity of the frame member when the leg moves relative to the frame member by a distance larger than a threshold. The digital printing toy can include an indicator operable to indicate that the ink jet printing head finishes printing the ink pattern on the supporting surface. In the digital printing toy, the ink jet printing head can be a color ink jet printing head. The digital printing toy can include a speaker.

In another aspect, instant application is directed to a digital toy kit. The digital toy kit includes a picture book and a digital printing toy. The picture book has a plurality of pages in which a page includes at least one of a printed picture and a printed word. The digital printing toy includes a frame member having a cavity, an ink jet printing head having one or more nozzles, a memory storing multiple objects, a display area, a selection button, and a printing control circuit. The ink jet printing head is operable to be activated to slide inside the cavity of the frame member when the digital printing toy is pressed against a chosen page on the picture book. The selection button is operable to select an object from the multiple objects. The printing control circuit controls the nozzles on ink jet printing head to project an ink pattern on the chosen page on the picture book when the ink jet printing head slides inside the cavity of the frame member.

Implementations of the digital printing toy may include one or more of the following features. In one implementation, the display area is operable to display an image of the selected object, and the ink pattern on the chosen page on the picture book represents a name of the selected object. In another implementation, the display area is operable to display a name of the selected object, and the ink pattern on the chosen page on the picture book represents an image of the selected object. In another implementation, the display area is operable to display an image of the selected object, and the ink pattern on the chosen page on the picture book represents the image of the selected object. In another implementation, the display area is operable to display a name of the selected object, and the ink pattern on the chosen page on the picture book represents the name of the selected object.

The digital printing toy has the advantage of providing an intuitive method for teaching a child to learn the name of an object. The digital printing toy also has the advantage of providing an appealing method for teaching a child to create stories on picture books.

Additional advantages of the invention will be set forth in the description which follows, and in part will be obvious from the description, or may be learned by practice of the invention. The advantages of the invention may be realized by means of the instrumentalities and combinations particularly pointed out in the claims.

BRIEF DESCRIPTION OF THE DRAWINGS

The present invention will be understood more fully from the detailed description and accompanying drawings of the invention set forth herein. However, the drawings are not to be construed as limiting the invention to the specific embodiments shown and described herein. Like reference numbers are designated in the various drawings to indicate like elements.

DETAILED DESCRIPTION

Figure 1:
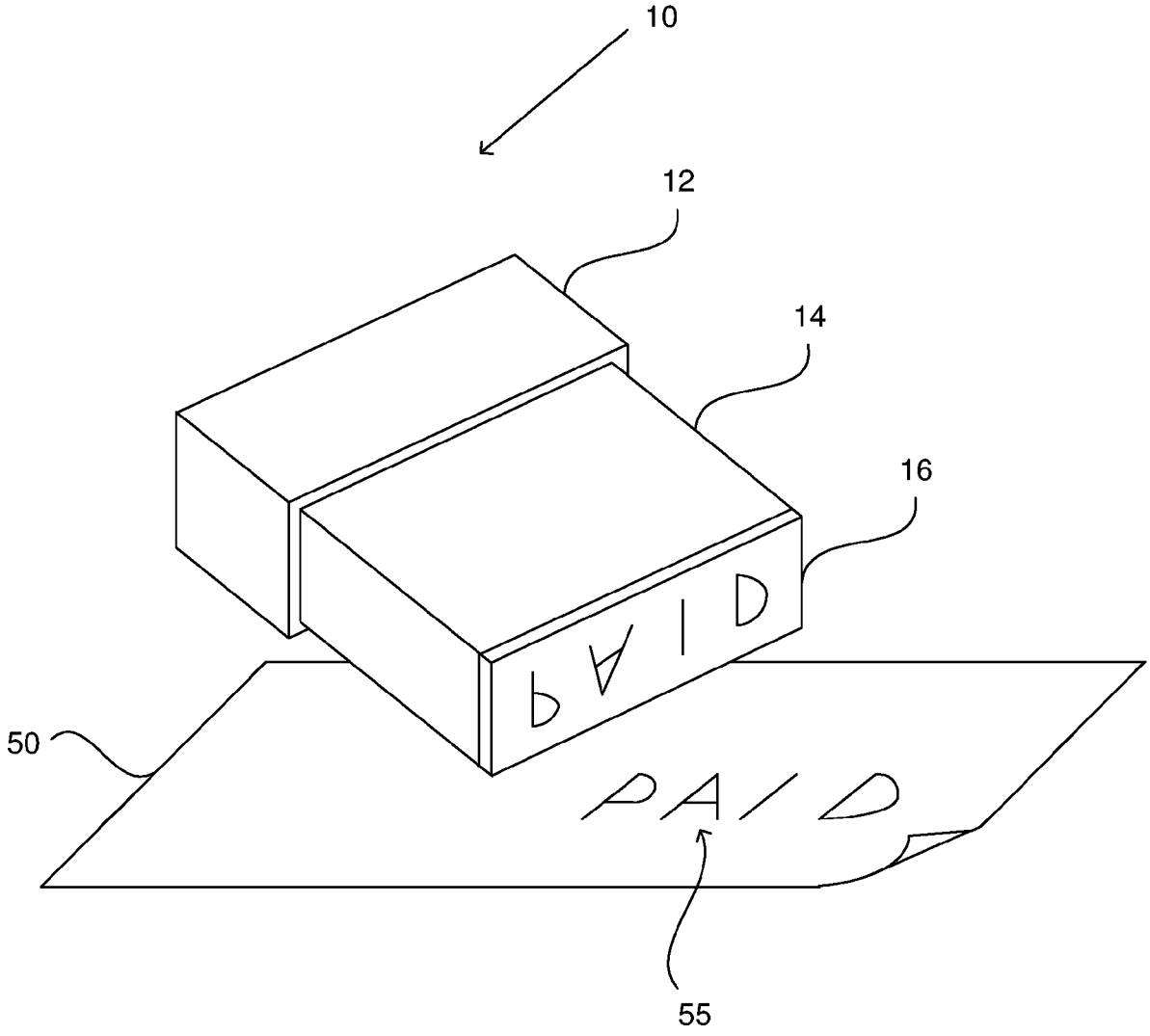
FIG. 1 shows a conventional stamp for imprinting a word "PAID" on a supporting surface.
Figure 2:
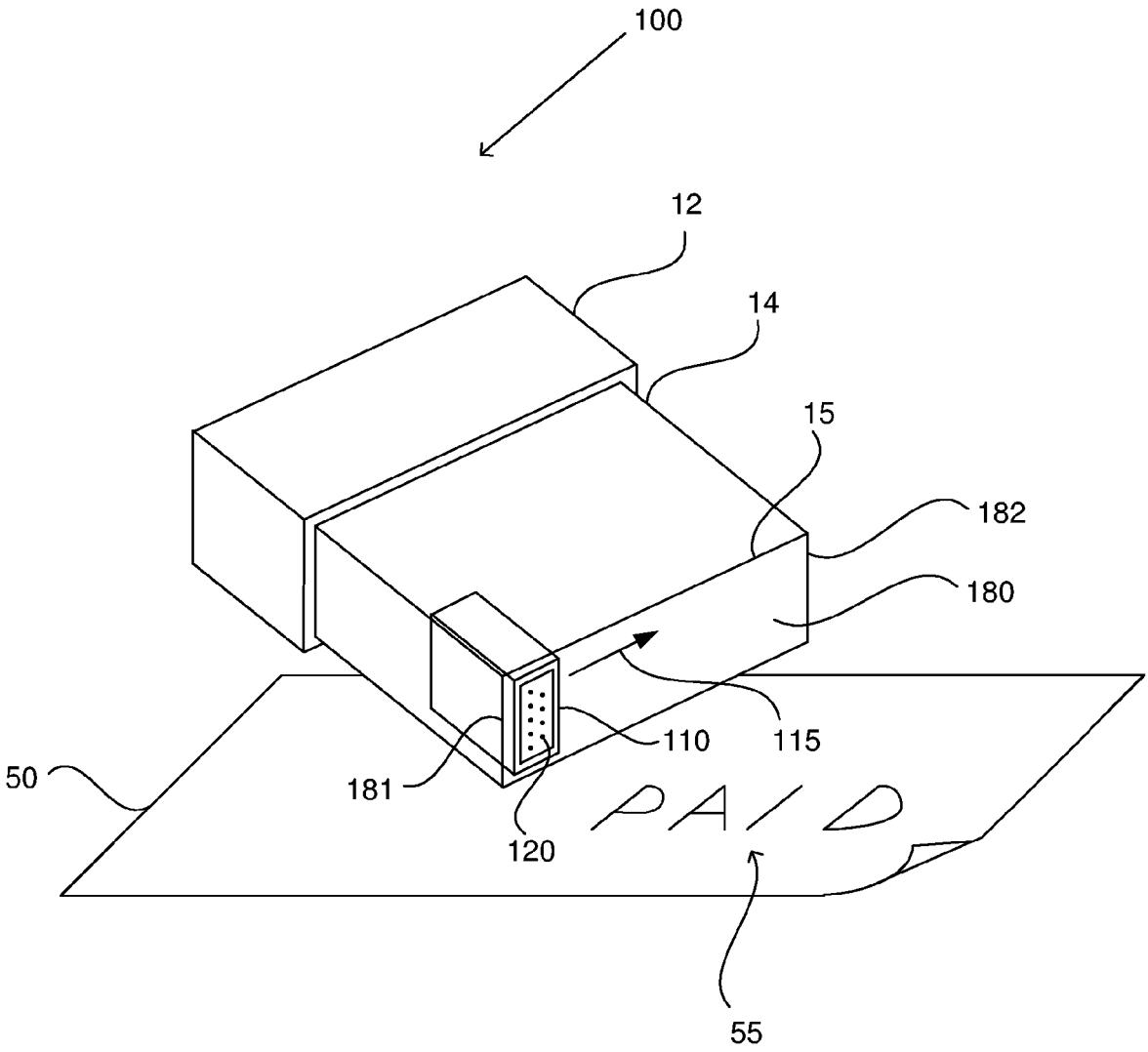
FIG. 2 shows a digital hand stamp for imprinting multiple images on a supporting surface.

FIG. 2 shows a digital hand stamp 100 that can imprint multiple images on a supporting surface 50. Digital hand stamp 100 includes a frame member 14 and an operating member 12. Operating member 12 is operatively associated with frame member 14. Frame member 14 includes a lower end 15 that is intended to bear against supporting surface 50. Frame member 14 includes a cavity 180. Cavity 180 can be rectangular in shape.

Digital hand stamp 100 also includes an ink jet printing head 110 having one or more nozzles 120. These nozzles 120 can be aligned in an array pattern, a matrix pattern or other defined patterns. An ink jet can be projected from a nozzle under the control of an external variable, such as an electrical signal. Ink jet printing head 110 can include a printing cartridge. Ink jet printing head 110 is installed in cavity 180. Cavity 180 includes a first end 181 and a second end 182. Ink jet printing head 110 can slide in a direction 115 from first end 181 to second end 182.

Figure 3A:
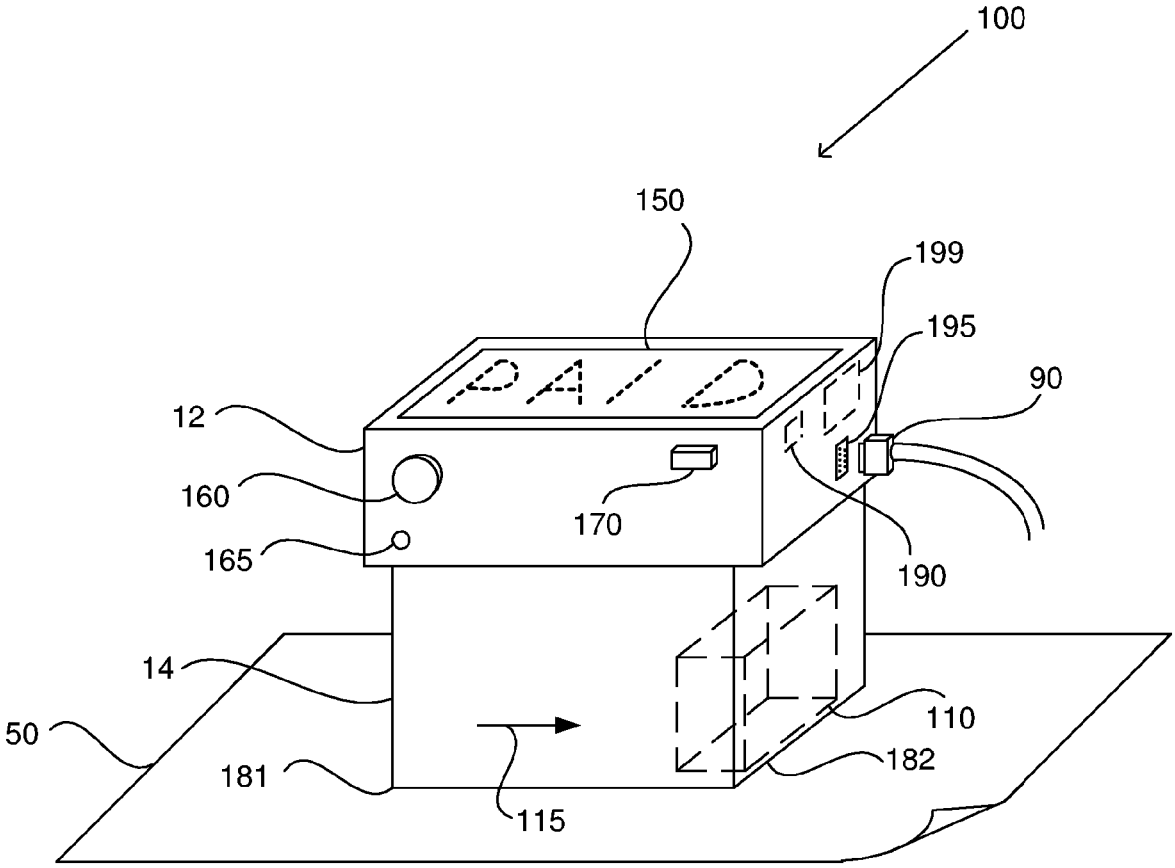
FIG. 3*a* shows that a digital hand stamp is pressed against a supporting surface and an ink jet printing head is activated to slide in a cavity.

As shown in FIG. 3*a*, when digital hand stamp 100 is pressed against supporting surface 50, ink jet printing head 110 can be activated to slide in direction 115 from first end 181 to second end 182. Ink jet printing head 110 can be activated to slide in direction 115 by pressing an activation button 160. Ink jet printing head 110 can also be activated automatically when digital hand stamp 100 is pressed against supporting surface 50. While ink jet printing head 110 is sliding in direction 115, the nozzles 120 on ink jet printing head 110 project ink patterns on supporting surface 50 under the control of a printing control circuit 199. After ink jet printing head 110 slide from first end 181 to second end 182, an ink pattern determined by printing control circuit 199 is imprinted on supporting surface 50.

Digital hand stamp 100 can include an indicator 165, such as an LED, to indicate that ink jet printing head 110 has finished sliding from first end 181 to second end 182 and that an ink pattern has been imprinted on supporting surface 50. The indicator 165 enable a user to lift digital hand stamp 100 from supporting surface 50 just after a complete ink pattern has been imprinted on supporting surface 50.

Figure 3B:
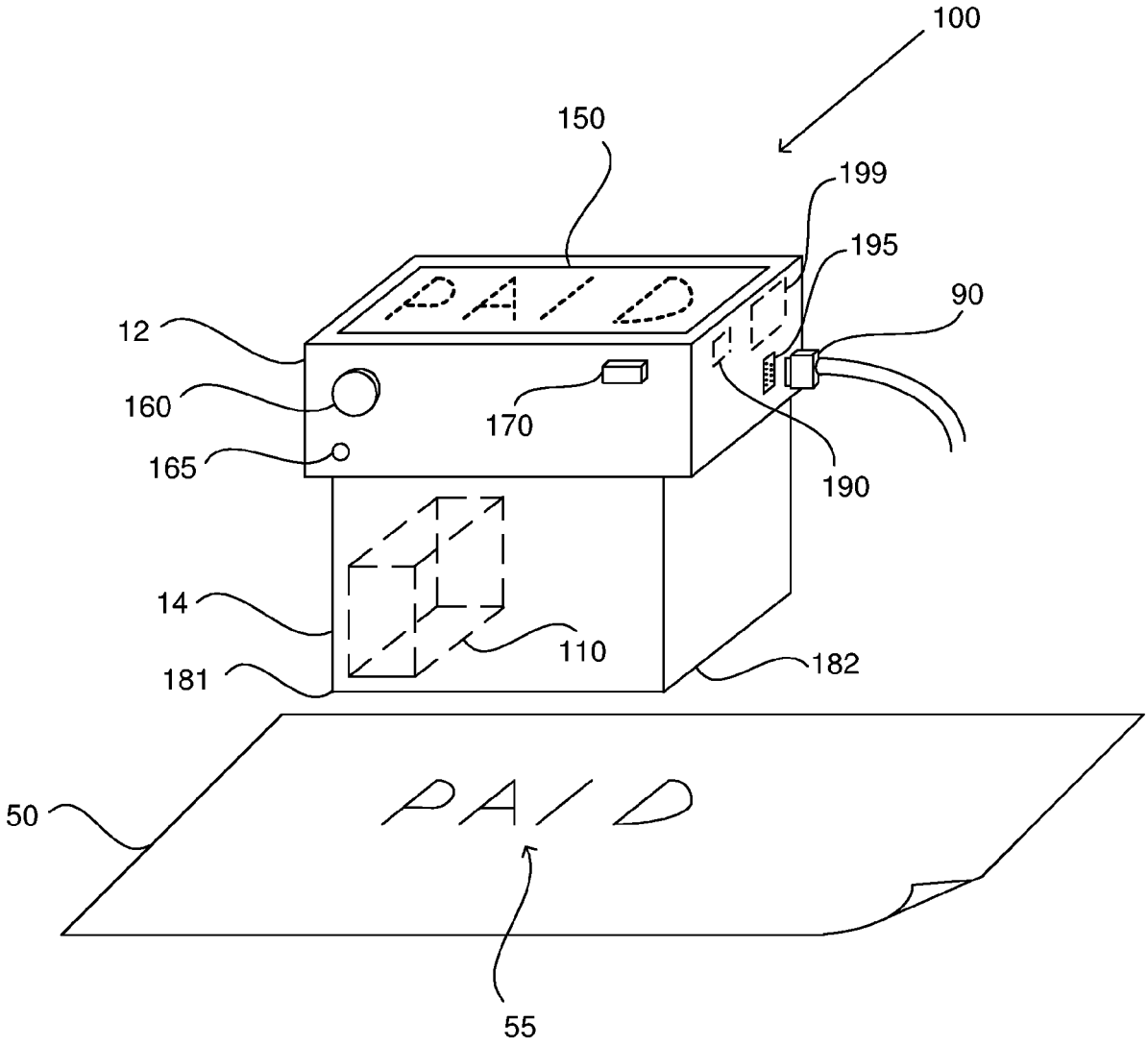
FIG. 3*b* shows that a digital hand stamp is lifted from a supporting surface and an image "PAID" is imprinted on the supporting surface.

As shown in FIG. 3*b*, when digital hand stamp 100 is lifted from supporting surface 50 after the printing process in FIG. 3*a*, an ink pattern, such as an image "PAID", is imprinted on supporting surface 50.

Because printing control circuit 199 controls the ink pattern to be imprinted, digital hand stamp 100 can easily imprint different ink patterns on supporting surface 50. For example, after digital hand stamp 100 prints an image "PAID", if digital hand stamp 100 is pressed again on supporting surface 50, digital hand stamp 100 can be programmed to print an image "VOID" under the control of printing control circuit 199.

Ink jet printing head 110 can be a color ink jet printing head. With a color ink jet printing head, digital hand stamp 100 can print either monochromic or color images.

Digital hand stamp 100 generally includes a memory 190 operable to store multiple images. Digital hand stamp 100 can also include an image selection button 170 to select one of the multiple images stored in memory 190. The selected image can be displayed in a display area 150. Display area 150 can display the image to be imprinted on supporting surface 50. Display area 150 can also display general instructions. Implementations of display area 150 can include a liquid crystal display ("LCD") or an organic light emitting display ("OLED").

In one implementation, the image displayed on display area 150 has the same size as the image imprinted on supporting surface 50. In another implementation, the image displayed on the display area 150 is proportional to the image imprinted on supporting surface 50 but has a size different from the size of the image imprinted on supporting surface 50.

FIG. 3*a* shows that digital hand stamp 100 can include a digital interface 195 for connecting digital hand stamp 100 with another digital device such as a personal computer or a digital camera. When digital hand stamp 100 is connected to a personal computer, the ink patterns to be imprinted on supporting surface 50 can be edited on the personal computer or down loaded from the personal computer. When digital hand stamp 100 is connected to a digital camera, the ink patterns to be imprinted on supporting surface 50 can be the same imaging patterns as captured by the digital camera.

Digital hand stamp 100 can also include one or more imaging editing buttons (not shown in the figure). Image editing buttons can be used to edit the image that is to be imprinted on supporting surface 50. As a specific example, image editing buttons can be letter keys to select the letters, numbers or words to be imprinted on supporting surface 50. As another specific example, image editing buttons can be used to enlarge or shrink proportionally an image to be imprinted on supporting surface 50.

Memory 190 can be a non-volatile memory, such as a flash memory or a ROM. Memory 190 can also be a removable memory storage media, such as a flash memory card, a smart memory card, or a memory stick. Digital hand stamp 100 can include a socket (not shown in the figure) for receiving a removable memory storage media. A variety of other kinds of solid state non-volatile memory can be also be used as memory 190.

When memory 190 is a non-volatile memory, digital hand stamp 100 can be operated as a stand-alone device without attaching to a personal computer or a digital camera. When digital hand stamp 100 is operated as a stand-alone device, it can be carried around more easily, and it can also be more useful in field applications. When memory 190 is a non-volatile memory, the multiple images stored in digital hand stamp 100 can be still kept intact when the power on the digital hand stamp 100 is turned off. This advantage of keeping images during power-off period makes the digital hand stamp 100 more useful and friendly to users.

Figure 4A:
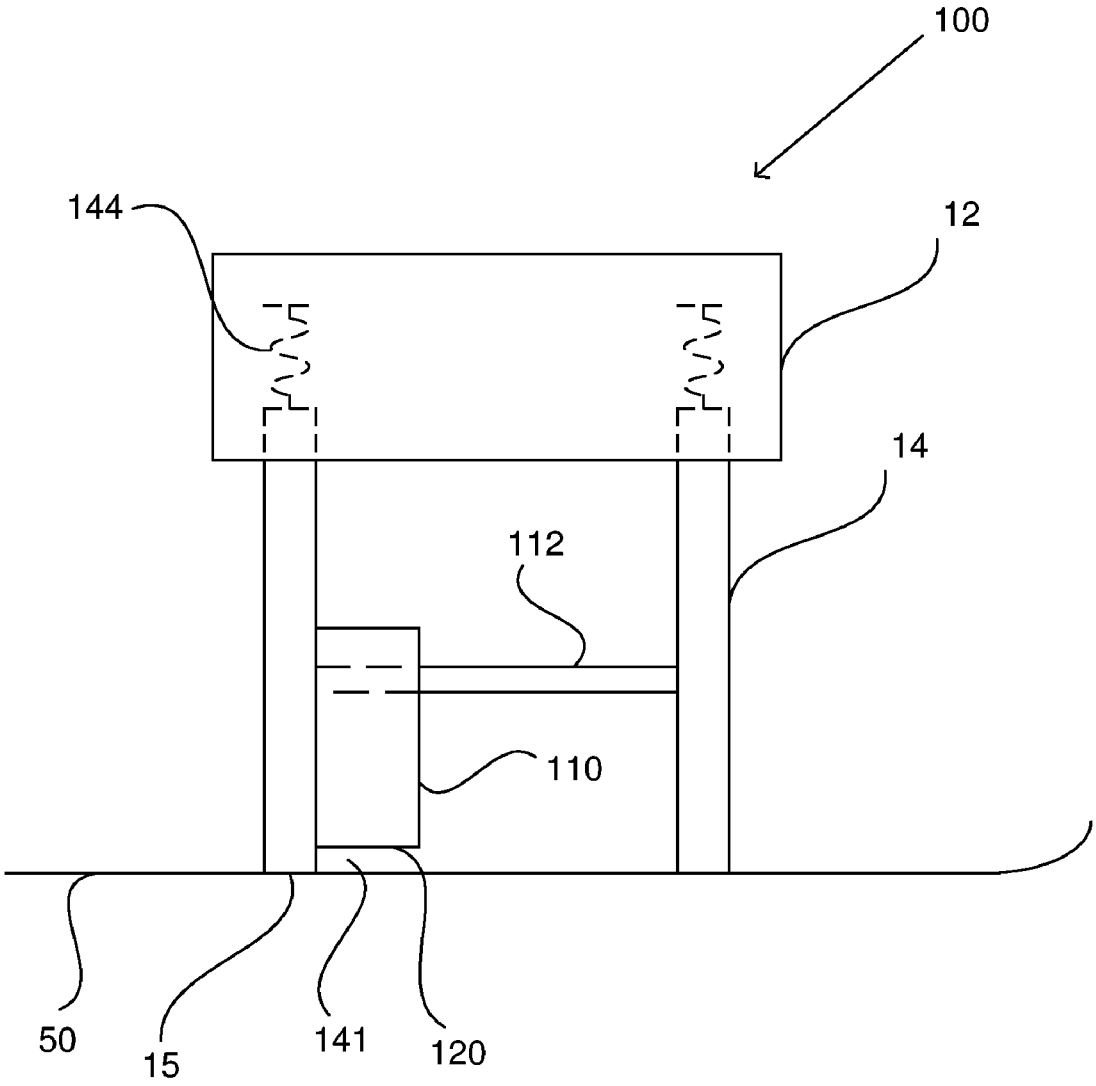
FIGS. 4*a* and 4*b* show a first sample implementation to enable an ink jet printing head be activated to slide in a cavity automatically.
Figure 4B:
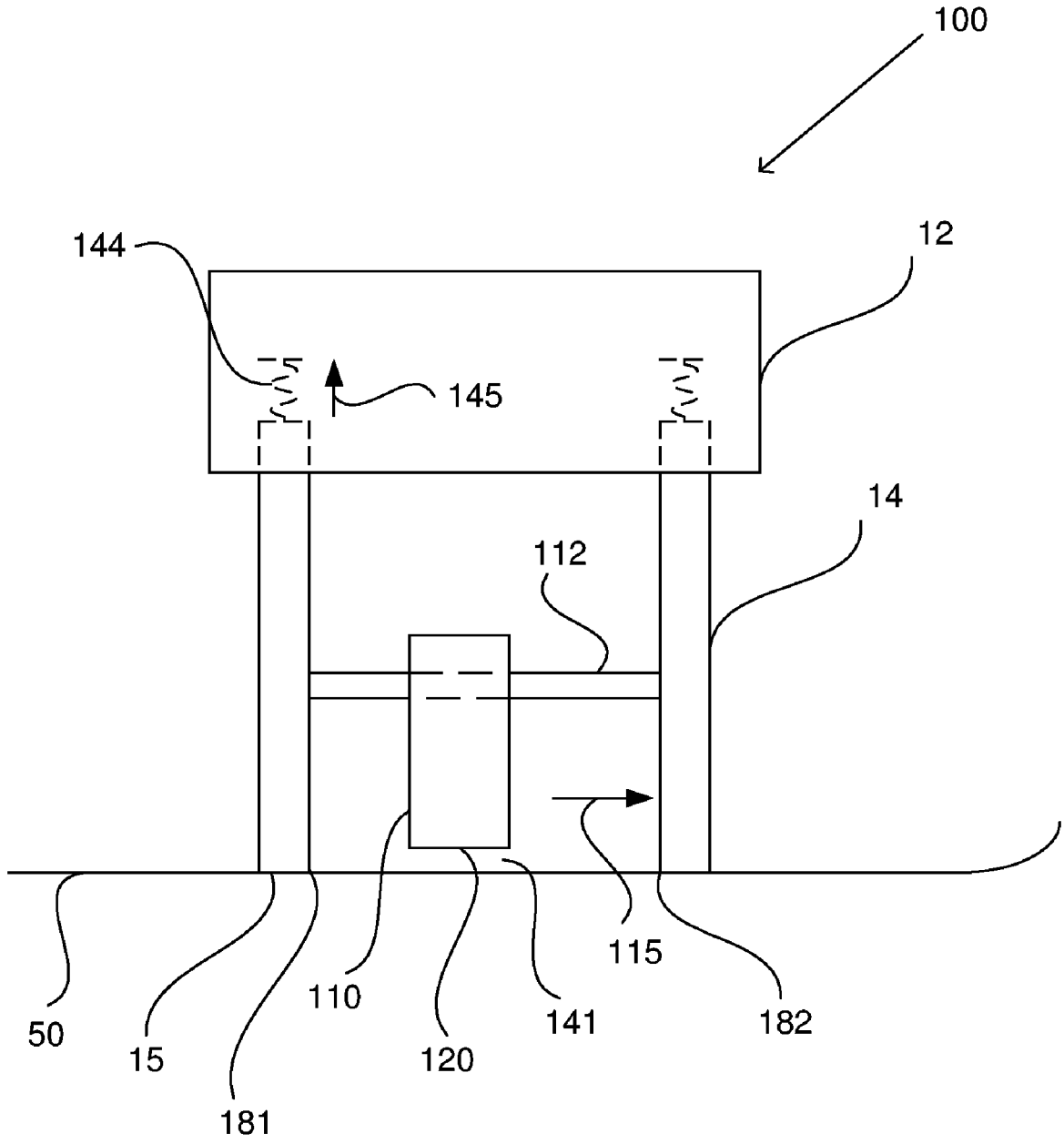
Figure 5A:
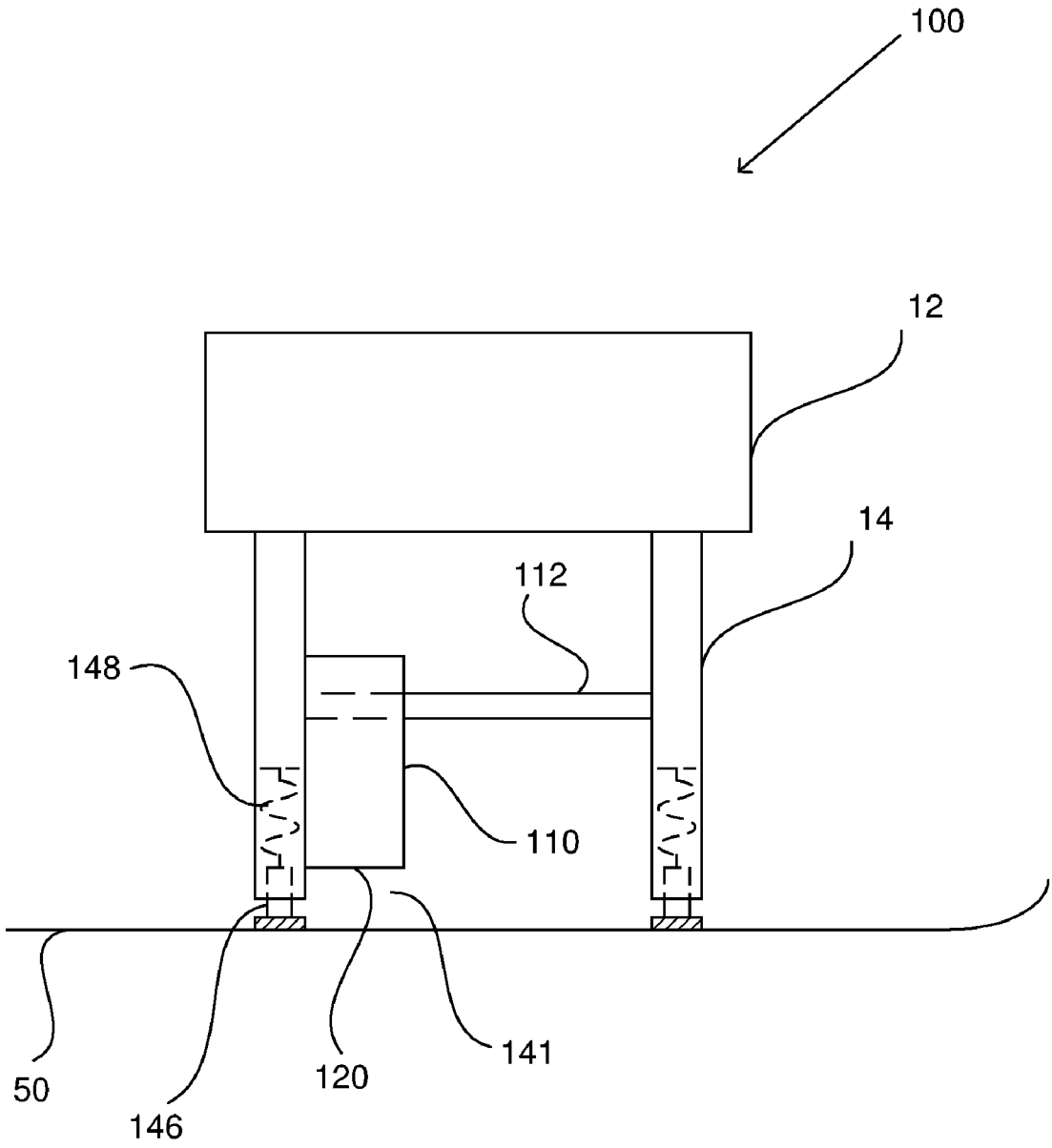
FIGS. 5*a* and 5*b* show a second sample implementation to enable an ink jet printing head be activated to slide in a cavity automatically.
Figure 5B:
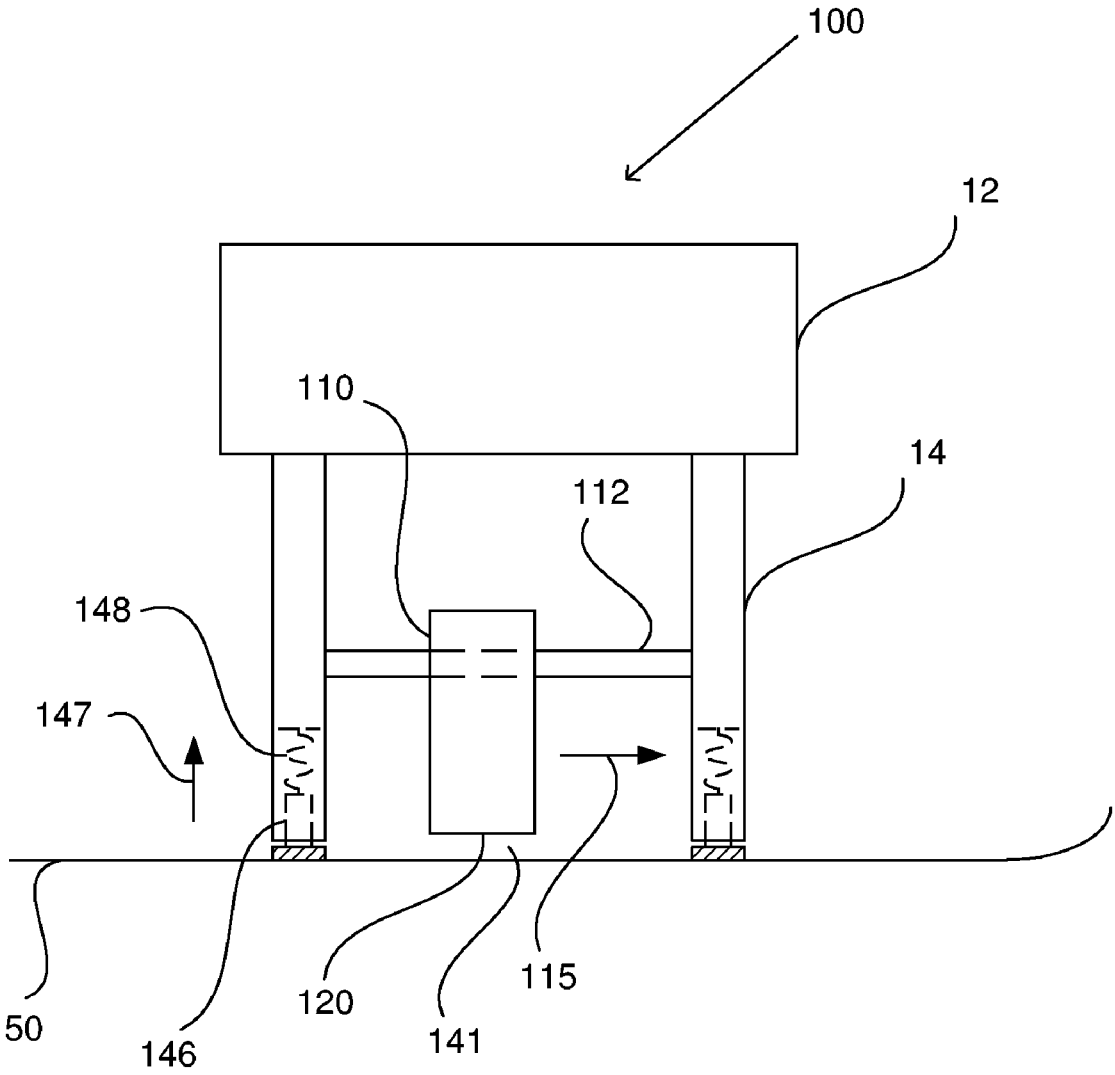

In FIG. 3*a*, ink jet printing head 110 can be activated to slide in direction 115 by pressing an activation button 160. Ink jet printing head 110 can be also activated automatically when digital hand stamp 100 is pressed against supporting surface 50. Many possible implementations are possible to enable ink jet printing head 110 be activated to slide in direction 115 automatically. FIGS. 4*a* and 4*b* show a first sample implementation. FIGS. 5*a* and 5*b* show a second sample implementation.

In FIGS. 4*a* and 4*b*, frame member 14 can move relative to operating member 12. Ink jet printing head 110 can slide along a sliding guide 112. Sliding guide 112 is fixed relative to operating member 12. Frame member 14 is biased against operating member 12 by a spring 144 such that a predetermined distance 141 exits between nozzles 120 and lower end 15. As shown in FIG. 4*b*, when digital hand stamp 100 is pushed against supporting surface 50, the length of spring 144 shrinks and frame member 14 moves relative to operating member 12 in a direction 145 as indicated in the figure. As frame member 14 moves relative to operating member 12, distance 141 decreases at the same time. When distance 141 is smaller than a threshold value and nozzles 120 is at a suitable distance to project inks onto supporting surface 50, ink jet printing head 110 is activated to slide in direction 115 and project ink patterns onto supporting surface 50 as controlled by printing control circuit 199.

Figure 4C:
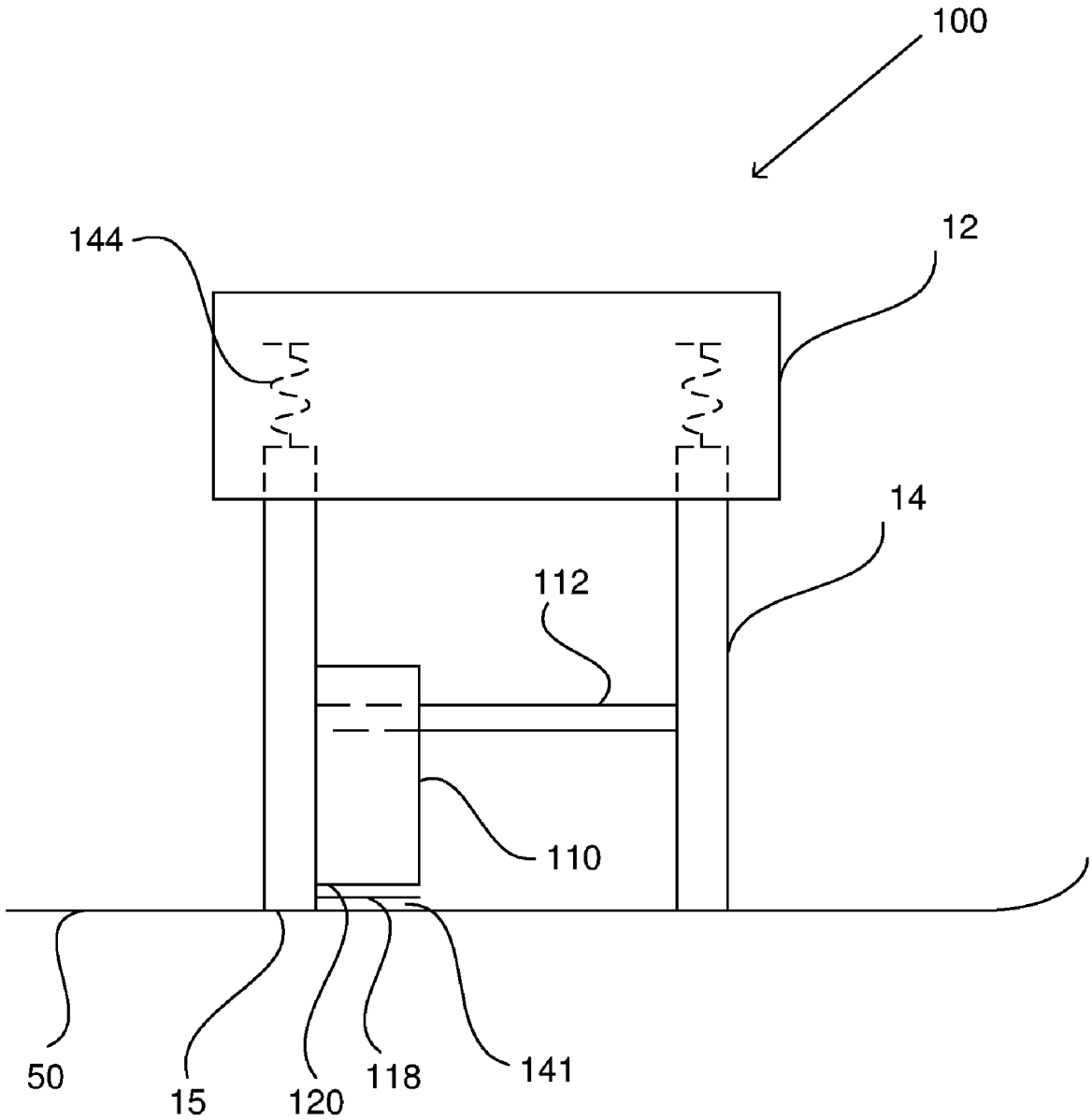
FIG. 4*c* shows that a digital hand stamp includes a protection cover for protecting the inkjet printing head.

FIG. 4*c* shows that digital hand stamp 100 can include a protection cover 118 for protecting ink jet printing head 110. Before digital hand stamp 100 is pressed against supporting surface 50, ink jet printing head 110 generally is at a position that nozzles 120 are protected by protection cover 118. Ink jet printing head 110 can slide along direction 115 to imprint an ink pattern on supporting surface 50. After ink jet printing head 110 finishes printing the ink pattern on supporting surface, ink jet printing head 110 again returns to a position that nozzles 120 are protected by protection cover 118.

In FIGS. 5*a* and 5*b*, frame member 14 is fixed relative to operating member 12. Ink jet printing head 110 can slide along a sliding guide 112. Sliding guide 112 is also fixed relative to operating member 12. Digital hand stamp 100 includes a leg 146 that is intended to bear against supporting surface 50. Leg 146 can move relative to frame member 14. Leg 146 is biased against frame member 14 by a spring 148 such that a predetermined distance 141 exits between nozzles 120 and supporting surface 50. As shown in FIG. 5*b*, when digital hand stamp 100 is pushed against supporting surface 50, the length of spring 148 shrinks and leg 146 moves relative to frame member 14 in a direction 147 as indicated in the figure. As leg 146 moves relative to frame member 14, distance 141 decreases at the same time. When distance 141 is smaller than a threshold value and nozzles 120 is at a suitable distance to project inks onto supporting surface 50, ink jet printing head 110 is activated to slide in direction 115 and project ink patterns onto supporting surface 50 as controlled by printing control circuit 199.

Figure 6A:
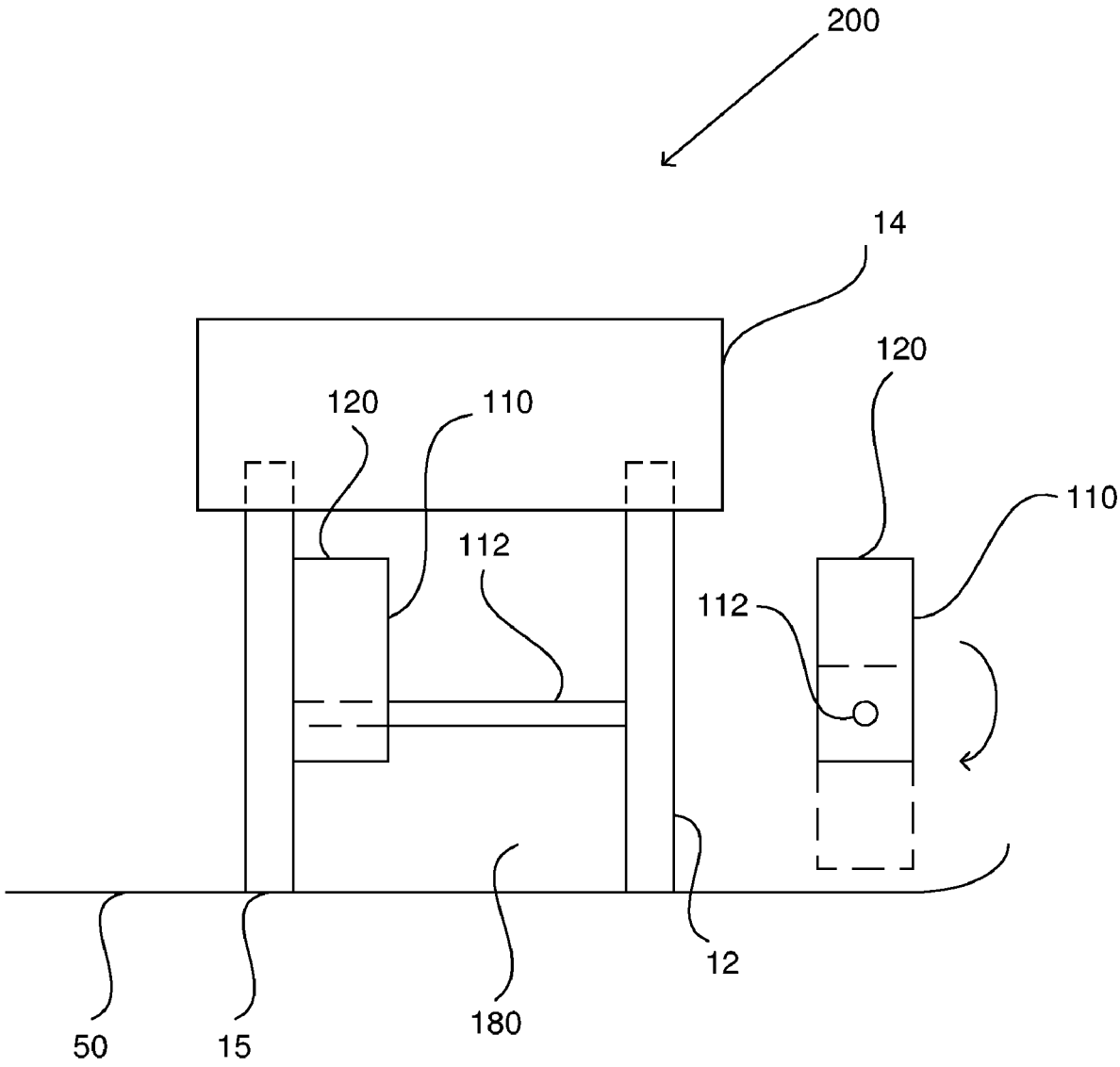
FIGS. 6*a* and 6*b* show an implementation of a digital hand stamp that uses designs similar to a self-inking stamp to enable an ink jet printing head be activated to slide in a cavity automatically.
Figure 6B:
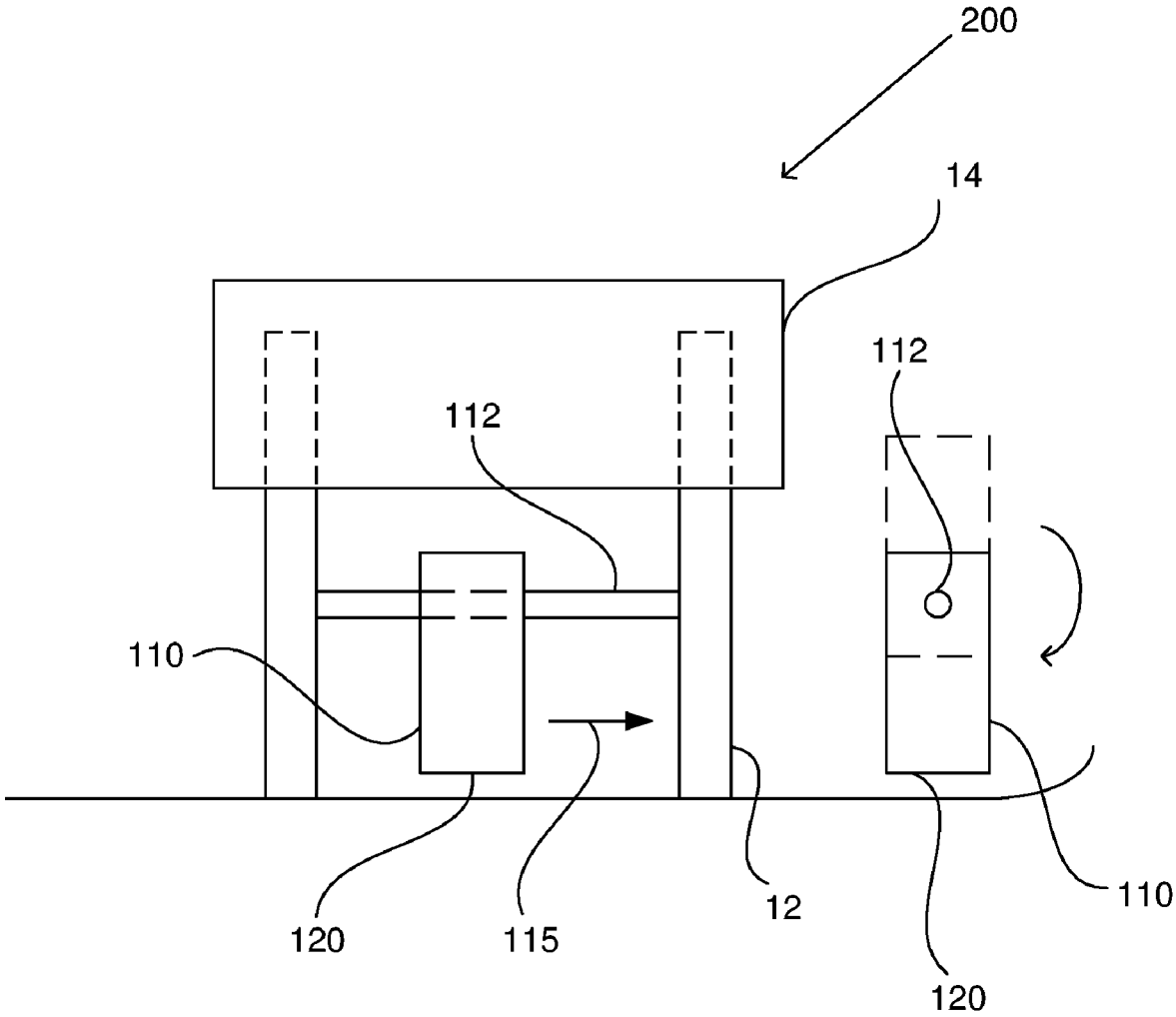

FIGS. 6*a* and 6*b* show an implementation of a digital hand stamp 200 that uses designs similar to some of the self-inking stamps to enable ink jet printing head 110 be activated to slide in direction 115. Digital hand stamp 200 includes a frame member 14 and an operating member 12. Operating member 12 is operatively associated with frame member 14. Frame member 14 includes a lower end 15 that is intended to bear against supporting surface 50. Frame member 14 includes a cavity 180. Cavity 180 can be rectangular in shape. Digital hand stamp 100 also includes an ink jet printing head 110 having one or more nozzles 120. Ink jet printing head 110 can slide along a sliding guide 112.

Before digital hand stamp 200 is pressed against supporting surface 50, inkjet printing head 110 is orientated in a direction such that nozzles 120 faces towards operating member 12. As digital hand stamp 200 is pressed against supporting surface 50, ink jet printing head 110 is flipped, for example, by about 180 degrees, and changes the orientation to a direction such that nozzles 120 faces towards supporting surface 50. When nozzles 120 faces towards supporting surface 50, ink jet printing head 110 can be activated to slide in direction 115 from first end 181 to second end 182 and project ink patterns onto supporting surface 50 as controlled by printing control circuit 199.

The designs of how to flip ink jet printing head 110 when digital hand stamp 200 is pressed against supporting surface 50 can be similar to those designs used in some of the self-inking stamps, for example, as described in U.S. Pat. No. 5,517,916 and U.S. Pat. No. 5,743,186.

Figure 7:
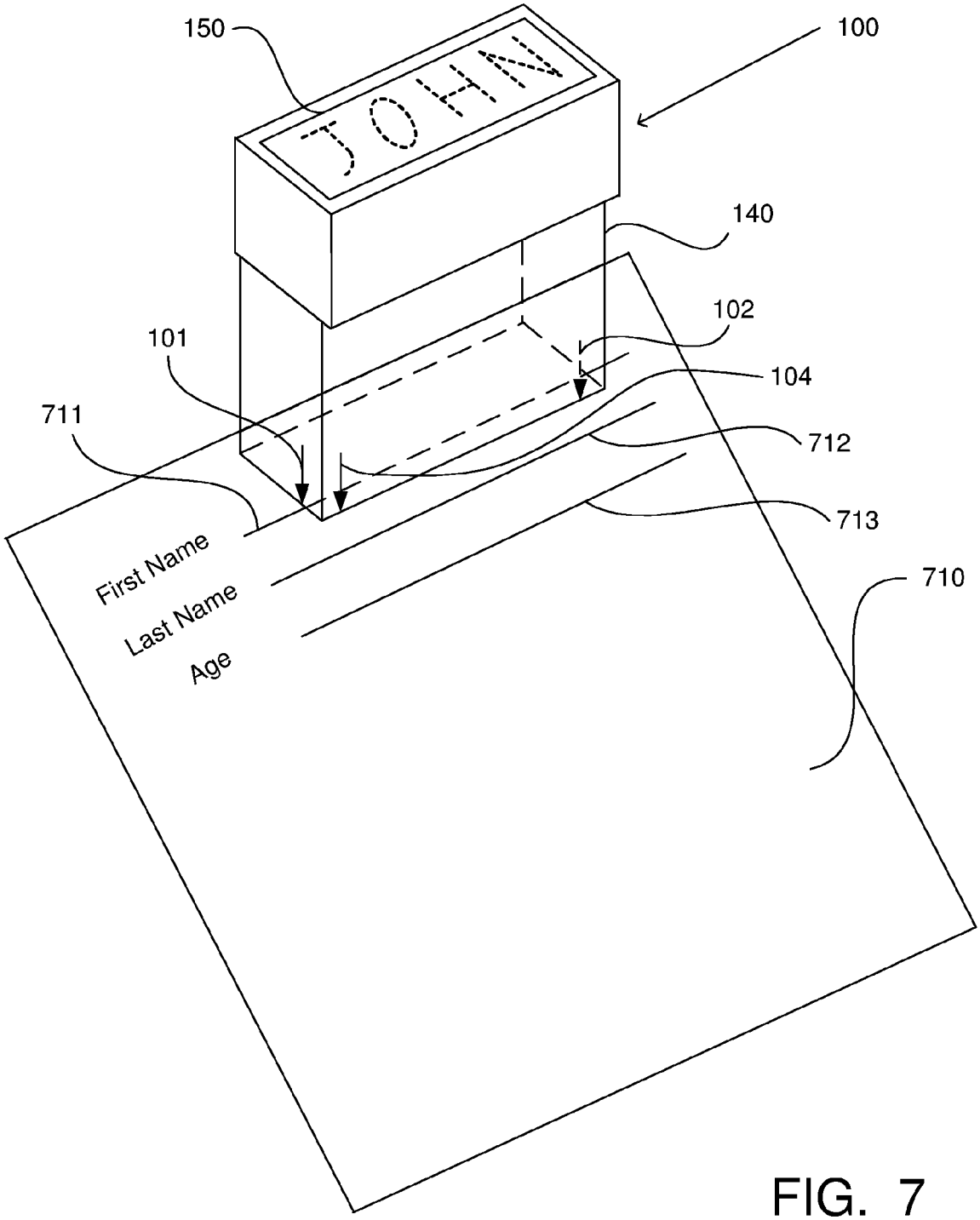
FIG. 7 shows that a digital hand stamp is used to fill up entries on a paper form.

A digital hand stamp with a memory for storing multiple images can have variety of applications. FIG. 7 shows that a digital hand stamp 100 is used to fill up entries on a paper form 710. The paper form 710 includes three entries: an entry 711 for "First Name", an entry 712 for "Last Name", an entry 713 for "Age". If three images representing words "JOHN", "SMITH", and "32" are stored in the memory in digital hand stamp 100, then, entries 711, 712, and 713 can be filled up, respectively, with "JOHN", "SMITH", and "32". More specifically, FIG. 7 shows that an image representing word "JOHN" is imprinted in a corresponding area on paper form 710 for entry 711, "First Name".

As shown in FIG. 7, digital hand stamp 100 can include one or more alignment markers for positioning digital hand stamp 100 correctly on paper form 710. For example, digital hand stamp 100 can include markers 101 and 102 for aligning digital hand stamp 100 horizontally with paper form 710. Digital hand stamp 100 can also include a marker 103 to enable each word be imprinted in the correct position in each of the entry in paper form 710. Markers 101, 102, and 103 can be on the sidewalls of frame member 14. Markers 101, 102, and 103 generally can be used to specify the position and the orientation of the image that is to be imprinted on a supporting surface.

Digital hand stamp 100 can also be modified to become a toy for children. For example, digital hand stamp 100 can be loaded with multiple colorful images that children like to draw or print on a piece of paper. Examples of these colorful images include dogs, cats, mice, fishes, ducks, chicken, tigers, cats, flowers, sun, and moon. These colorful images can be stored in memory 190 on digital hand stamp 100. An image selection button 170 on digital hand stamp 100 can be used to select which one of the colorful images in memory 190 is to be printed.

Figure 8A:
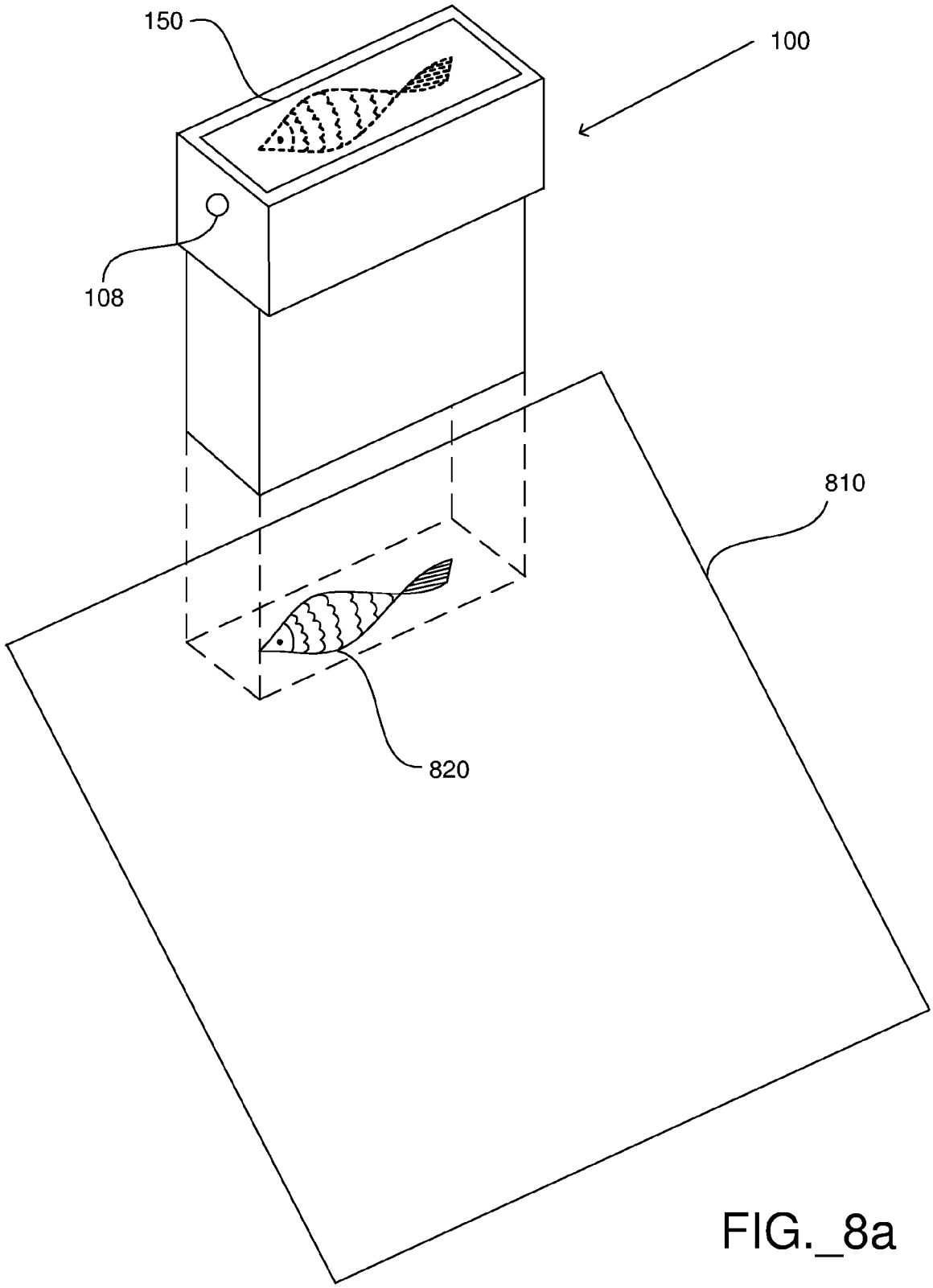
FIG. 8*a* shows that an image of a fish is printed on a piece of paper.

Digital hand stamp 100 can include a display area 150 to display the image that is to be printed. FIG. 8*a* shows that an image of a fish is printed on a piece of paper 810. The image of fish is also displayed in display area 150. Digital hand stamp 100 can also include a speaker 108. When an image of an object is printed on the piece of paper 810, the name of the object can be pronounced by speaker 108 at the same time.

Figure 8B:
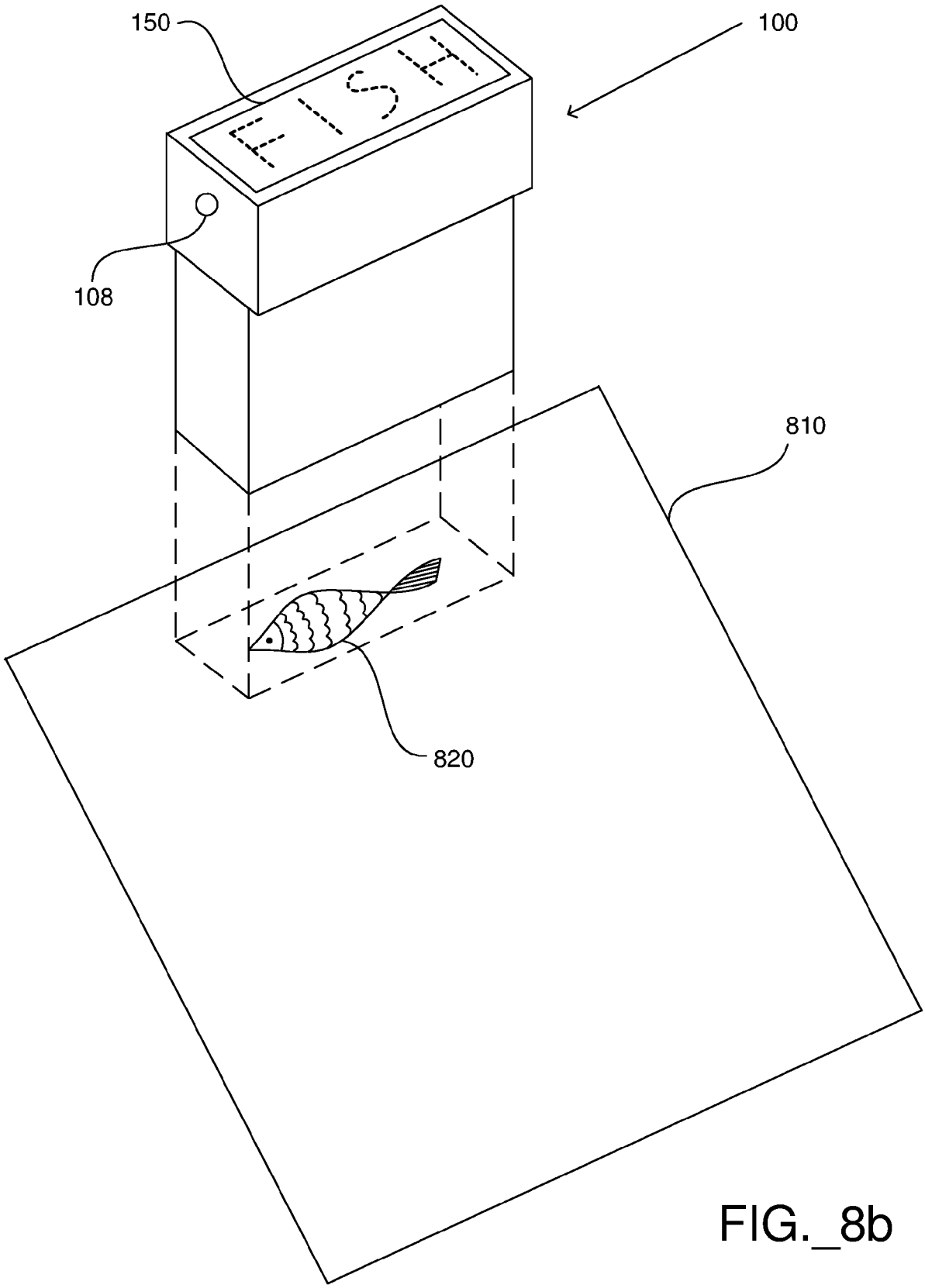
FIG. 8*b* shows that a word "FISH" is displayed in a display area and an image of a fish is printed on a piece of paper.

In another implementation, instead of displaying in display are 150 the image of an object that is to be printed, the name of the object can be displayed in display area 150. For example, FIG. 8*b* shows that a word "FISH" is displayed in display area 150 and an image of fish is printed on a piece of paper 810. Memory 190 in digital hand stamp 100 can store the images of a list of objects and the names of the list of objects. A user can use image selection button 170 to select the name of an object to be printed while the name of the object is displayed in display area 150. A user can also use letter keys (not shown in the figure) to enter the name of an object to be printed. After the selection, when digital hand stamp 100 is pushed against the piece of paper 810, the corresponding image of the selected object can be printed. Speaker 108 can pronounce the name of the selected object at the same time. With this implementation, digital hand stamp 100 essentially can be used as a picture dictionary.

Figure 8C:
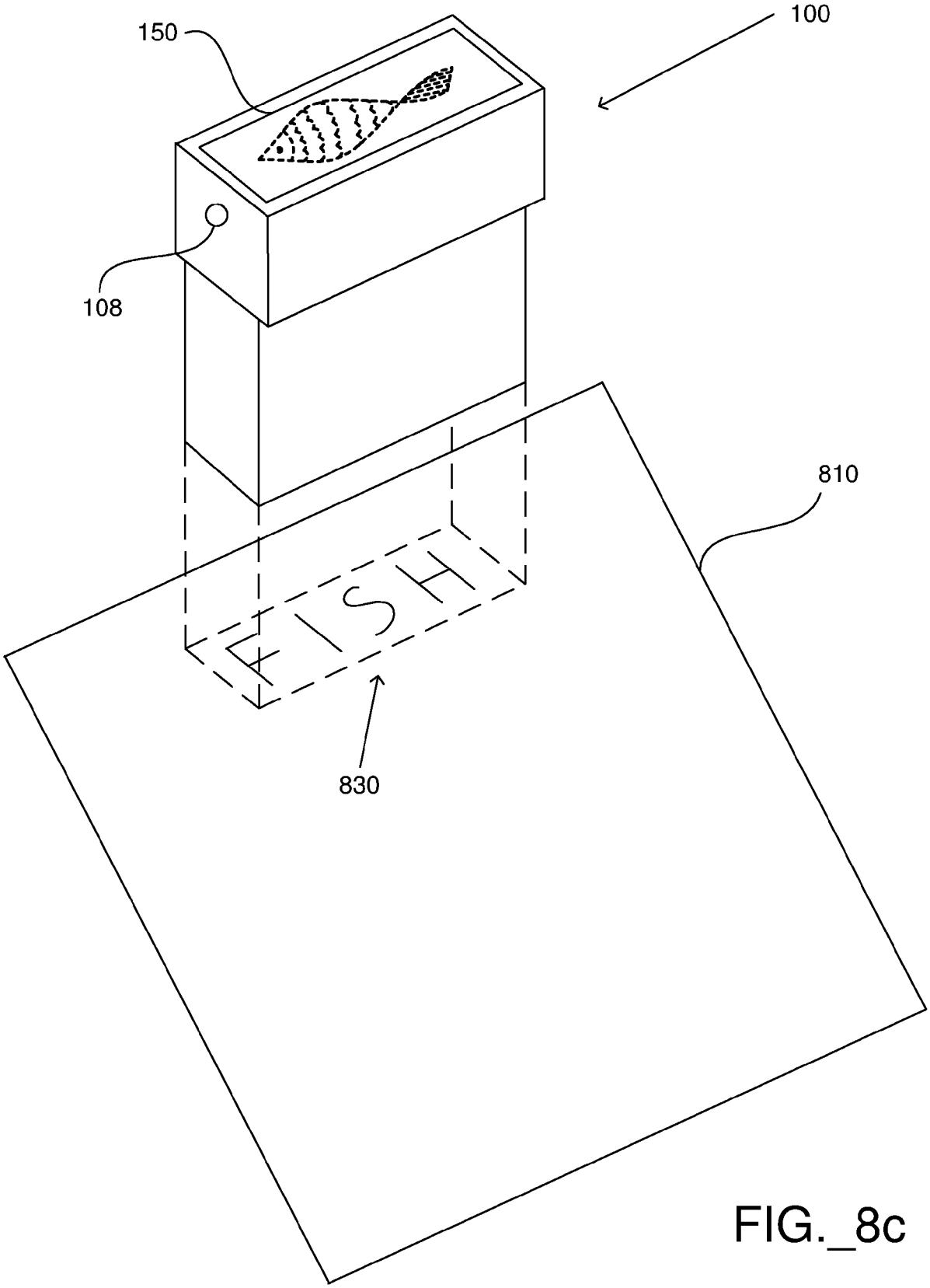
FIG. 8*c* shows that an image of a fish is displayed in a display area and a word "FISH" is printed on a piece of paper.

In yet another implementation, an image of an object is displayed in display area 150 and the name of the object is printed on a piece of paper 810. For example, FIG. 8*c* shows that an image of a fish is displayed in display area 150 and a word "FISH" is printed on a piece of paper 810. A user can use image selection button 170 to select the image of an object to be printed while the image of the object is displayed in display area 150. After the selection, when digital hand stamp 100 is pushed against the piece of paper 810, the corresponding name of the selected object can be printed. Speaker 108 can pronounce the name of the selected object at the same time.

In the implementations as shown in FIGS. 8*a*-8*c*, speaker 108 can pronounce the name of the selected object. Speaker 108 can also mimic the sound generated by an animal (e.g., dogs, cats, or ducks) when an image of the animal is represented by the selected object. Speaker 108 can still mimic the sound of other objects (e.g., ocean, trains, or cars).

Figure 9A:
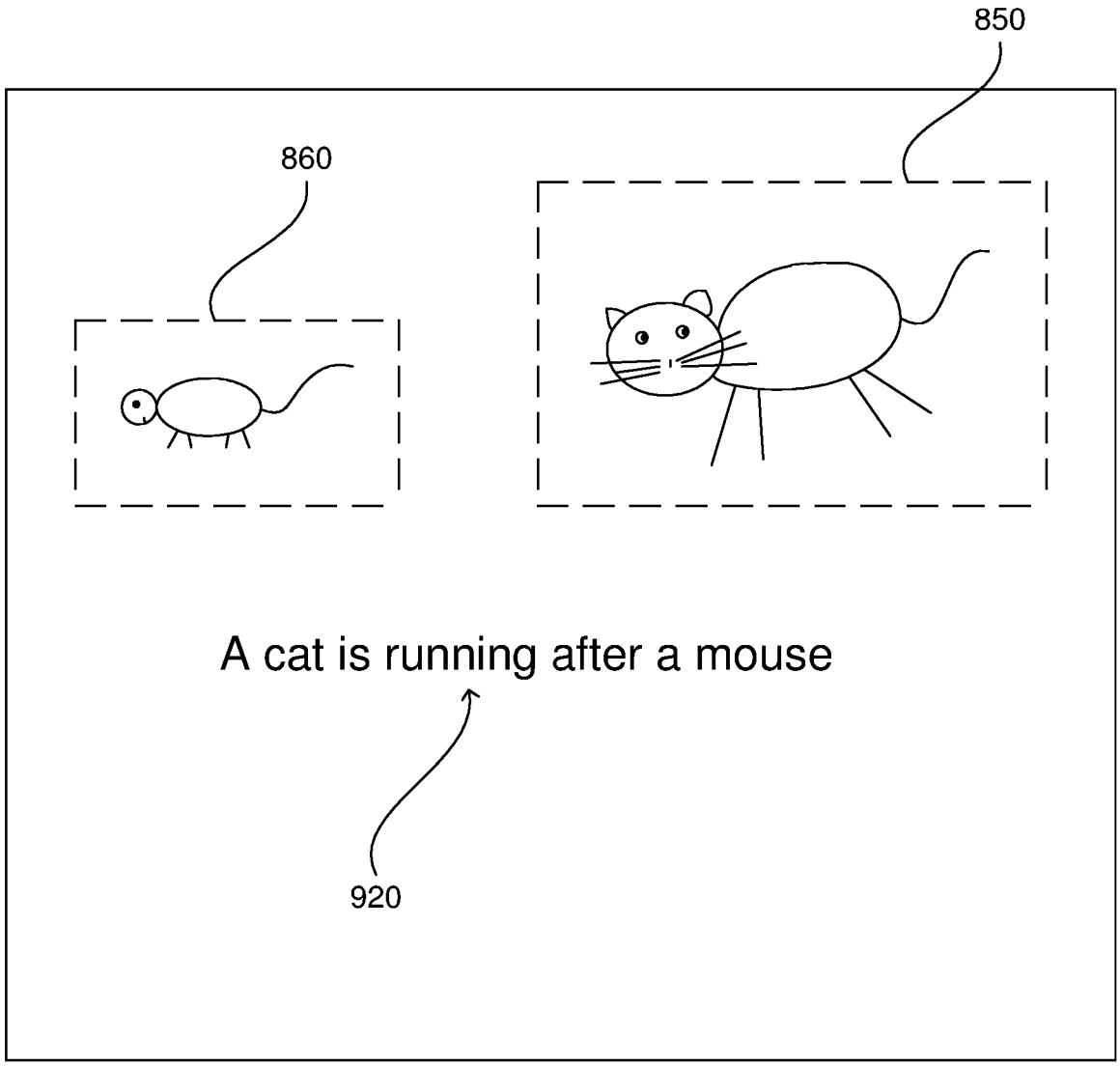
FIG. 9*a* shows that a child can use a digital hand stamp to draw pictures.

FIG. 9*a* shows that a child can use digital hand stamp 100 to draw pictures. As shown in FIG. 9*a*, when a child is asked to illustrate a sentence that states "a cat is running after a mouse", the child can print an image of cat 850 and an image of mouse 860. The child also needs to position the two images at the correct positions.

Figure 9B:
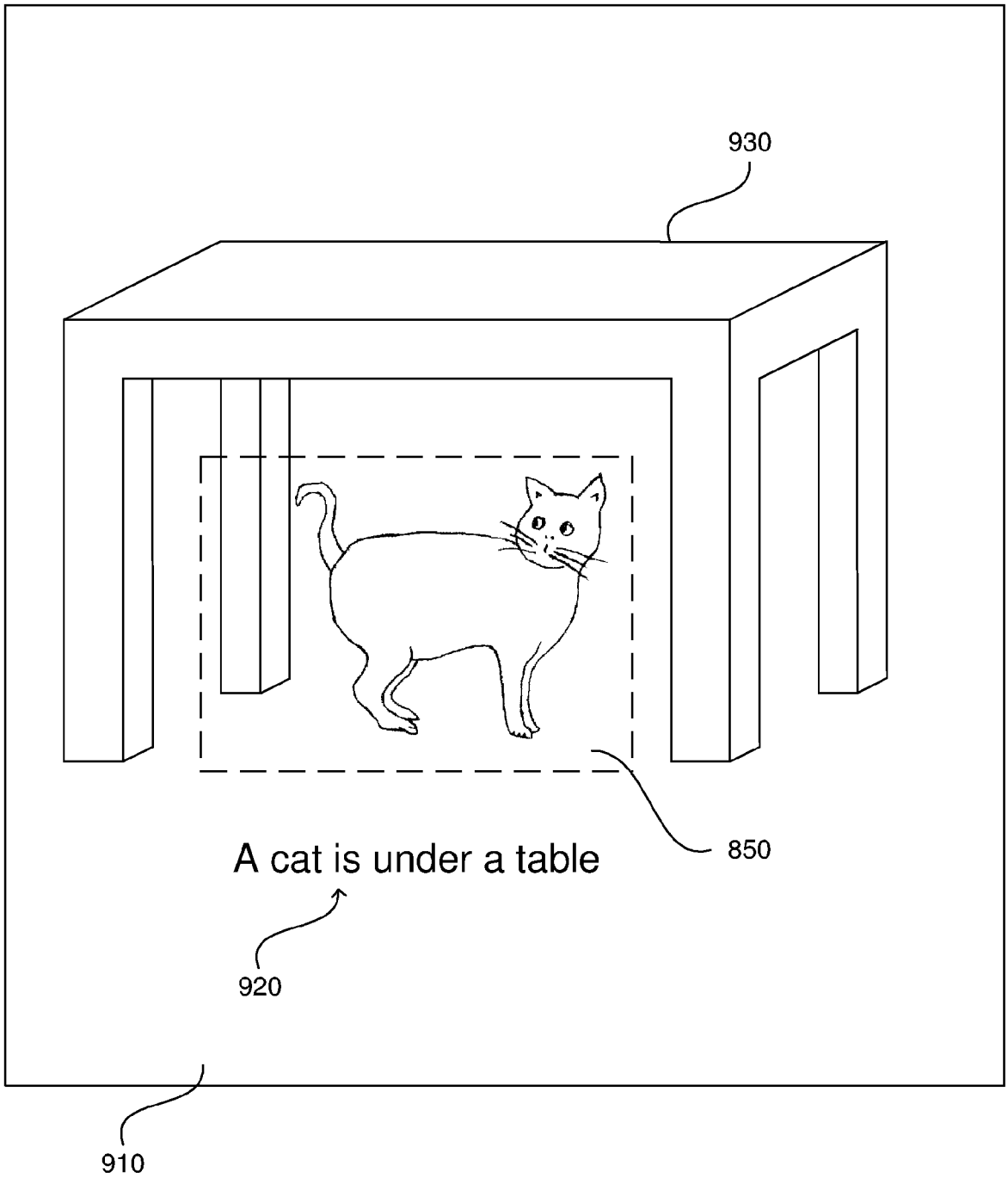
FIG. 9*b* shows that a child can use a digital hand stamp to modify a picture book.

FIG. 9*b* shows that a child can use digital hand stamp 100 to modify a picture book. In FIG. 9*b*, a page 910 on a picture book includes a table 930. When a child is asked to modify the page to illustrate a sentence that states "a cat is under a table", the child need to print an image of cat 850 at the correct position.

When a picture book tells a story that includes several characters, digital hand stamp 100 can be used by a child to finish the drawings on each page of the picture book. For this purpose, the images of the characters can be stored in digital hand stamp 100 and each page of the picture book can be provided with either complete drawings or partial drawings; a child is asked to complete those partial drawings.

Based on above teachings, other applications are also possible for the digital hand stamp with a memory.

The present invention has been described in terms of a number of implementations. The invention, however, is not limited to the implementations depicted and described. Rather, the scope of the invention is defined by the appended claims.

What is claimed is:

1. A method for teaching a child to learn the name of an object using a digital printing toy, the digital printing toy having a memory and a display area, the method comprising:

storing multiple objects in the memory;

selecting an object from the multiple objects;

displaying a name of the selected object on the display area;

holding the digital printing toy against a supporting surface;

activating an ink jet printing head to slide inside a cavity on a frame member of the digital printing toy; and controlling nozzles on the ink jet printing head to project an ink pattern on the supporting surface when the ink jet printing head slides inside the cavity of the frame member, wherein the ink pattern on the supporting surface represents an image of the selected object.

2. The method of claim 1, wherein the storing multiple objects comprises storing in the memory at least a name and at least an image for at least one of the multiple objects.

3. The method of claim 1, wherein the activating an ink jet printing head comprises activating an ink jet printing head to slide inside a cavity on a frame member of the digital hand stamp while keeping a substantially constant distance between the ink jet printing head and the supporting surface.

4. The method of claim 1, further comprising pressing an activation button to activate the ink jet printing head to slide inside the cavity of the frame member when the digital printing toy is pressed against the supporting surface.

5. The method of claim 1, further comprising pressing the digital printing toy against the supporting surface to activate the ink jet printing head to slide inside the cavity of the frame member automatically.

6. The method of claim 5, further comprising moving the frame member relative to a operating member by a distance larger than a threshold to activate the ink jet printing head to slide inside the cavity of the frame member automatically.

7. The method of claim 5, further comprising moving a leg relative to the frame member by a distance larger than a threshold to activate the ink jet printing head to slide inside the cavity of the frame member automatically.

8. The method of claim 1, further comprising lifting the digital printing toy when an indicator on the digital printing toy indicates that that the ink jet printing head finishes printing the ink pattern on the supporting surface.

9. The method of claim 1, further comprising pronouncing the name of the selected object with a speaker on the digital printing toy.

10. A method for teaching a child to learn the name of an object using a digital printing toy, the digital printing toy having a memory and a display area, the method comprising:

storing multiple objects in the memory;

selecting an object from the multiple objects;

displaying an image of the selected object on the display area;

holding the digital printing toy against a supporting surface;

activating an ink jet printing head to slide inside a cavity on a frame member of the digital printing toy; and controlling nozzles on the ink jet printing head to project an ink pattern on the supporting surface when the ink jet printing head slides inside the cavity of the frame member, wherein the ink pattern on the supporting surface represents a name of the selected object.

11. The method of claim 10, wherein the storing multiple objects comprises storing in the memory at least a name and at least an image for at least one of the multiple objects.

12. The method of claim 10, wherein the activating an ink jet printing head comprises activating an ink jet printing head to slide inside a cavity on a frame member of the digital hand stamp while keeping a substantially constant distance between the ink jet printing head and the supporting surface.

13. The method of claim 10, further comprising pressing an activation button to activate the ink jet printing head to slide inside the cavity of the frame member when the digital printing toy is pressed against the supporting surface.

14. The method of claim 10, further comprising pressing the digital printing toy against the supporting surface to activate the ink jet printing head to slide inside the cavity of the frame member automatically.

15. The method of claim 14, further comprising moving the frame member relative to a operating member by a distance larger than a threshold to activate the ink jet printing head to slide inside the cavity of the frame member automatically.

16. The method of claim 14, further comprising moving a leg relative to the frame member by a distance larger than a threshold to activate the ink jet printing head to slide inside the cavity of the frame member automatically.

17. The method of claim 10, further comprising lifting the digital printing toy when an indicator on the digital printing toy indicates that that the ink jet printing head finishes printing the ink pattern on the supporting surface.

18. The method of claim 10, further comprising pronouncing the name of the selected object with a speaker on the digital printing toy.

19. A digital printing toy operable to print an image of an object on a supporting surface, comprising:

a frame member having a cavity;

an ink jet printing head having one or more nozzles, the ink jet printing head operable to be activated to slide inside the cavity of the frame member when the digital printing toy is pressed against the supporting surface;

a memory having multiple objects stored therein;

a selection button operable to select an object from the multiple objects;

a display area operable to display a name of a selected object; and a printing control circuit controlling the nozzles on ink jet printing head to project an ink pattern on the supporting surface when the ink jet printing head slides inside the cavity of the frame member, wherein the ink pattern on the supporting surface represents an image of the selected object.

20. The digital printing toy of claim 19, wherein the memory has at least a name and at least an image stored therein for at least one of the multiple objects.

21. The digital printing toy of claim 19, further comprising:

a sliding guide inside the cavity, and the ink jet printing head operable to be activated to slide along the sliding guide.

22. The digital printing toy of claim 19, further comprising an activation button operable to be pressed to activate the ink jet printing head to slide inside the cavity of the frame member when the digital printing toy is pressed against the supporting surface.

23. The digital printing toy of claim 19, wherein the ink jet printing head is operable to be activated automatically to slide inside the cavity of the frame member when the digital printing toy is pressed against the supporting surface.

24. The digital printing toy of claim 23, further comprising an operating member, wherein the frame member is movable relative to the operating member, the ink jet printing head operable to be activated automatically to slide inside the cavity of the frame member when the frame member moves relative to the operating member by a distance larger than a threshold.

25. The digital printing toy of claim 23, further comprising a leg movable relative to the frame member, the ink jet printing head operable to be activated automatically to slide inside the cavity of the frame member when the leg moves relative to the frame member by a distance larger than a threshold.

26. The digital printing toy of claim 23, further comprising an indicator operable to. indicate that the ink jet printing head finishes printing the ink pattern on the supporting surface.

27. The digital printing toy of claim 23, wherein the ink jet printing head is a color ink jet printing head.

28. The digital printing toy of claim 23, further comprising a speaker.

29. A digital printing toy operable to print a name of an object on a supporting surface, comprising:

a frame member having a cavity;

an ink jet printing head having one or more nozzles, the ink jet printing head operable to be activated to slide inside the cavity of the frame member when the digital printing toy is pressed against the supporting surface;

a memory having multiple objects stored therein;

a selection button operable to select an object from the multiple objects;

a display area operable to display an image of a selected object; and a printing control circuit controlling the nozzles on inkjet printing head to project an ink pattern on the supporting surface when the ink jet printing head slides inside the cavity of the frame member, wherein the ink pattern on the supporting surface represents a name of the selected object.

30. The digital printing toy of claim 29, wherein the memory has at least a name and at least an image stored therein for at least one of the multiple objects.

31. The digital printing toy of claim 29, further comprising:

a sliding guide inside the cavity, and the inkjet printing head operable to be activated to slide along the sliding guide.

32. The digital printing toy of claim 29, further comprising an activation button operable to be pressed to activate the ink jet printing head to slide inside the cavity of the frame member when the digital printing toy is pressed against the supporting surface.

33. The digital printing toy of claim 29, wherein the ink jet printing head is operable to be activated automatically to slide inside the cavity of the frame member when the digital printing toy is pressed against the supporting surface.

34. The digital printing toy of claim 33, further comprising an operating member, wherein the frame member is movable relative to the operating member, the ink jet printing head operable to be activated automatically to slide inside the cavity of the frame member when the frame member moves relative to the operating member by a distance larger than a threshold.

35. The digital printing toy of claim 33, further comprising a leg movable relative to the frame member, the ink jet printing head operable to be activated automatically to slide inside the cavity of the frame member when the leg moves relative to the frame member by a distance larger than a threshold.

36. The digital printing toy of claim 33, further comprising an indicator operable to indicate that the ink jet printing head finishes printing the ink pattern on the supporting surface.

37. The digital printing toy of claim 33, wherein the ink jet printing head is a color ink jet printing head.

38. The digital printing toy of claim 33, further comprising a speaker.

39. A digital toy kit comprising:

a picture book having a plurality of pages wherein a page comprises at least one of a picture and a word printed thereon; and a digital printing toy that comprises, a frame member having a cavity, an ink jet printing head having one or more nozzles, the ink jet printing head operable to be activated to slide inside the cavity of the frame member when the digital printing toy is pressed against a chosen page on the picture book, a memory storing multiple objects, a display area thereon, a selection button operable to select an object from the multiple objects, and a printing control circuit controlling the nozzles on ink jet printing head to project an ink pattern on the chosen page on the picture book when the ink jet printing head slides inside the cavity of the frame member.

40. The digital toy kit of claim 39, wherein the display area is operable to display an image of the Selected object, and the ink pattern on the chosen page on the picture book represents a name of the selected object.

41. The digital toy kit of claim 39, wherein the display area is operable to display a name of the selected object, and the ink pattern on the chosen page on the picture book represents an image of the selected object.

42. The digital. toy kit of claim 39, wherein the display area is operable to display an image of the selected object, and the ink pattern on the chosen page on the picture book represents the image of the selected object.

43. The digital toy kit of claim 39, wherein the display area is operable to display a name of the selected object, and the ink pattern on the chosen page on the picture book represents the name of the selected object.

* * * * *